US006137984A

United States Patent [19]

Higashi et al.

[11] Patent Number: 6,137,984

[45] Date of Patent: Oct. 24, 2000

[54] TONER IMAGE FIXING APPARATUS

[75] Inventors: Yuichiro Higashi; Takeshi Kato; Youichi Ishikawa, all of Tokyo, Japan

[73] Assignee: Nitto Kogyo Co., Ltd., Tokyo, Japan

[21] Appl. No.: 09/244,120

[22] Filed: Feb. 4, 1999

[51] Int. Cl.[7] ..... G03G 15/20

[52] U.S. Cl. ..... 399/329; 399/328; 219/216

[58] Field of Search ..... 399/329, 328, 399/330, 331; 219/216

[56] References Cited

U.S. PATENT DOCUMENTS 5,857,136 1/1999 Yoneda et al. ..... 399/329
5,873,020 2/1999 Matsuura et al. ..... 399/329

*Primary Examiner*—Richard Moses
*Attorney, Agent, or Firm*—Armstrong, Westerman, Hattori, McLeland & Naughton

[57] ABSTRACT

A toner image fixing apparatus has a fixing roller, a pressing roller, and a heating roller which are rotatable about their own axes. The pressing roller presses a sheet carrying an unfixed toner image against the fixing roller to fix the unfixed toner image to the sheet. The heating roller is disposed on one side of the fixing roller remotely from the pressing roller. An endless heat transfer belt is trained around the heating and fixing rollers for transferring heat from a heater to heat the unfixed toner image on the sheet. A guide plate is positioned upstream of the pressing roller for guiding the sheet to enter between the fixing and pressing rollers. The heat transfer belt and the guide plate are so spaced from each other that the sheet prior to being entering between the fixing and pressing rollers is kept out of contact with the heat transfer belt. The heat transfer belt may be positioned outside of a region where the sheet guided by the guide plate possibly passes. An angle between a line segment interconnecting the centers of the heating and fixing rollers and a reference line interconnecting the centers of the fixing and pressing rollers lies in a range from 105° to 255°. The fixing roller is a resilient roller with an outer resilient layer. The temperatures of the fixing and pressing rollers are kept in a predetermined temperature range in a standby mode.

16 Claims, 5 Drawing Sheets

TONER IMAGE FIXING APPARATUS

BACKGROUND OF THE INVENTION

1. Field of the Invention

The present invention relates to a toner image fixing apparatus for fusing and pressing a toner on a recording medium to fix the toner to the recording medium in an image forming system such as a copying machine, a printer, a facsimile machine, etc.

2. Description of the Related Art

One recent toner image fixing apparatus for use in electrophotographic machines is illustrated in FIG. 5 of the accompanying drawings, which is disclosed in Japanese Patent Application (Laid-open) HEI6-318001. As shown in FIG. 5, the toner image fixing apparatus has a fixing roller R1, a heating and tensioning roller R3, an endless fixing belt B trained around the rollers R1, R3, and a pressing roller R2 disposed below and pressed against the fixing roller R1 with the fixing belt B interposed therebetween. When a recording medium D in the form of a sheet with an unfixed toner image carried thereon is fed into the toner image fixing apparatus by a sheet feeder, the recording medium D is reheated by the heating and tensioning roller R3, and then the toner image is fixed to the recording medium D by the fixing belt B in a nipping region between the rollers R1, R2.

Since the recording medium D is preheated, the nipping region may be set to a relatively low temperature. The fixing belt B is of such a small heat capacity that when the recording medium D passes through the nipping region, the temperature of the fixing belt B is quickly lowered to increase the coherent ability of the toner which is separated from the fixing belt B at the outlet of the nipping region, for thereby allowing the toner to be easily separated from the fixing belt B. Even if the fixing belt B is free of oil or coated with a small amount of oil, a clear fixed toner image can be produced on the recording medium D without offsets. The toner image fixing apparatus shown in FIG. 5 is thus capable of solving the problems of toner separation and coil coating, which have not been eliminated by other toner image fixing apparatus using only a heating roller.

The conventional toner image fixing apparatus shown in FIG. 5 will be described in greater detail. The pressing roller R2 is positioned directly beneath the fixing roller R1, and the heating and tensioning roller R3 is disposed upstream of the fixing roller R1 with respect the direction in which the recording medium D is fed into the toner image fixing apparatus along the fixing belt B that is trained around the rollers R1, R3.

The toner image fixing apparatus also has an oil coating roller R4 disposed above an upper run of the fixing belt B. A guide plate G for supporting the recording medium D is disposed below a lower run of the fixing belt B, and a gap between the guide plate G and the lower run of the fixing belt B serves as a preheating passage P for preheating the recording medium D when the recording medium D travels below the heating and tensioning roller R3 toward the nipping region.

The fixing belt B is tensioned to a desired tension level when the heating and tensioning roller R3 is pushed away from the fixing roller R1 by a pressing lever U. The fixing belt B is actuated by the fixing roller R1 which is coupled to an actuator. Since the fixing belt B is appropriately tensioned, it can stably rotate around the rollers R1, R3 without undesirable slippage and sagging.

A heater H is housed in the heating and tensioning roller R3. The heating and tensioning roller R3 is associated with a thermistor S for measuring the temperature of the surface of a core of the heating and tensioning roller R3.

In the conventional toner image fixing apparatus, the gap between the guide plate G and the lower run of the fixing belt B is defined as the preheating passage P for preheating the recording medium D. When the recording medium D carrying an unfixed toner image on its upper surface is transferred along the upper surface of the guide plate G, if the recording medium D is curled, jumps up, or sags due to a speed difference between the toner image fixing apparatus and a preceding toner image transferring apparatus, the recording medium D tends to be partially curved upwardly into contact with the lower run of the fixing belt B. When this happens, the unfixed toner image on the recording medium D is disturbed, failing to produce a desired image on the recording medium D. It has been desired to obviate this drawback.

The above shortcoming is basically caused because of the fixing belt B. One solution, therefore, is to employ a toner image fixing apparatus having no fixing belt B rather than the toner image fixing apparatus shown in FIG. 9. With no fixing belt B used, the heater H has to be housed in the fixing roller R1, and the fixing roller R1 needs to be a metal roller because the outer circumferential surface of the fixing roller R1 should be quickly heated. As a result, if a sufficient nipping width is to be provided in the nipping region between the fixing roller R1 and the pressing roller R2, the pressing roller R2 is required of necessity to be in the form of a resilient roller.

The resilient pressing roller R2 has its outer circumferential surface pressed to a downwardly concave shape by the fixing roller R1 in the nipping region. This downwardly concave nipping region provided by the resilient pressing roller R2, together with the tendency of the recording medium D with the unfixed toner image on its upper surface to stick to the outer circumferential surface of the fixing roller R1, causes the recording medium D to stick easily to the outer circumferential surface of the fixing roller R1. The phenomenon that a recording medium in the form of a sheet sticks to a fixing roller is referred to as a sheet offset. There are demands for improvements to prevent sheet offsets.

SUMMARY OF THE INVENTION

It is a major object of the present invention to provide a toner image fixing apparatus which is capable of fixing an unfixed toner image carried on a recording medium to the recording medium without disturbing the unfixed toner image irrespective of how the recording medium may be curled while it is being fed in the toner image fixing apparatus.

Another object of the present invention is to provide a toner image fixing apparatus which has a heating roller positioned with respect to a fixing roller under specific conditions for fixing an unfixed toner image carried on a recording medium to the recording medium without disturbing the unfixed toner image irrespective of how the recording medium is curled while it is being fed in the toner image fixing apparatus.

Still another object of the present invention is to provide a toner image fixing apparatus which prevents a recording medium from being easily offset after an unfixed toner image is fixed thereto.

In order to attain the above-mentioned abjects, there is provided a toner image fixing apparatus according to a first aspect of the present invention, which comprises a fixing roller, a pressing roller normally urged toward said fixing roller for pressing a sheet with an unfixed toner image carried on a surface thereof against said fixing roller to fix the unfixed toner image to said sheet when said sheet passes in one direction through a rolling contact region between said fixing roller and said pressing roller, a heating roller disposed on one side of said fixing roller opposite to said pressing roller, said heating roller having heating means disposed therein for heating said heating roller, an endless heat transfer belt trained around said heating roller and said fixing roller for transferring heat from said heating means to heat the unfixed toner image on said sheet when said sheet passes through said rolling contact region, and a support member fixedly positioned upstream of said pressing roller with respect to said one direction, for supporting an opposite surface of said sheet before said sheet passes through said rolling contact region, said endless heat transfer belt and said support member being so spaced from each other that said sheet is kept out of contact with said endless heat transfer belt before said sheet supported by said support member passes through said rolling contact region.

According to a second aspect of the present invention, there is provided a toner image fixing apparatus comprises a fixing roller, a pressing roller normally urged toward said fixing roller for pressing a sheet with an unfixed toner image carried on a surface thereof against said fixing roller to fix the unfixed toner image to said sheet when said sheet passes in one direction through a rolling contact region between said fixing roller and said pressing roller, a heating roller disposed on one side of said fixing roller opposite to said pressing roller, said heating roller having heating means disposed therein for heating said heating roller, an endless heat transfer belt trained around said heating roller and said fixing roller for transferring heat from said heating means to heat the unfixed toner image on said sheet when said sheet passes through said rolling contact region, and a support member fixedly positioned upstream of said pressing roller with respect to said one direction, for supporting an opposite surface of said sheet before said sheet passes through said rolling contact region, said endless heat transfer belt being positioned outside of a region where said sheet supported by said support member possibly passes.

According to a third aspect of the present invention, there is provided a toner image fixing apparatus comprises a fixing roller, a pressing roller normally urged toward said fixing roller for pressing a sheet with an unfixed toner image carried on a surface thereof against said fixing roller to fix the unfixed toner image to said sheet when said sheet passes in one direction through a rolling contact region between said fixing roller and said pressing roller, a heating roller disposed on one side of said fixing roller opposite to said pressing roller, said heating roller having heating means disposed therein for heating said heating roller, and an endless heat transfer belt trained around said heating roller and said fixing roller for transferring heat from said heating means to heat the unfixed toner image on said sheet when said sheet passes through said rolling contact region, said heating roller being angularly positioned with respect to said fixing roller such that an angle formed between a line segment interconnecting the center of said heating roller and the center of said fixing roller and a reference line interconnecting the center of said fixing roller and the center of said pressing roller lies in a range from 105° to 255°.

According to a fourth aspect of the present invention, there is provided a toner image fixing apparatus comprises a fixing roller, a pressing roller normally urged toward said fixing roller for pressing a sheet with an unfixed toner image carried on a surface thereof against said fixing roller to fix the unfixed toner image to said sheet when said sheet passes in one direction through a rolling contact region between said fixing roller and said pressing roller, a heating roller disposed on one side of said fixing roller opposite to said pressing roller, said heating roller having heating means disposed therein for heating said heating roller, and an endless heat transfer belt trained around said heating roller and said fixing roller for transferring heat from said heating means to heat the unfixed toner image on said sheet when said sheet passes through said rolling contact region, said fixing roller comprising a resilient roller having a resilient layer on an outer circumferential surface thereof.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
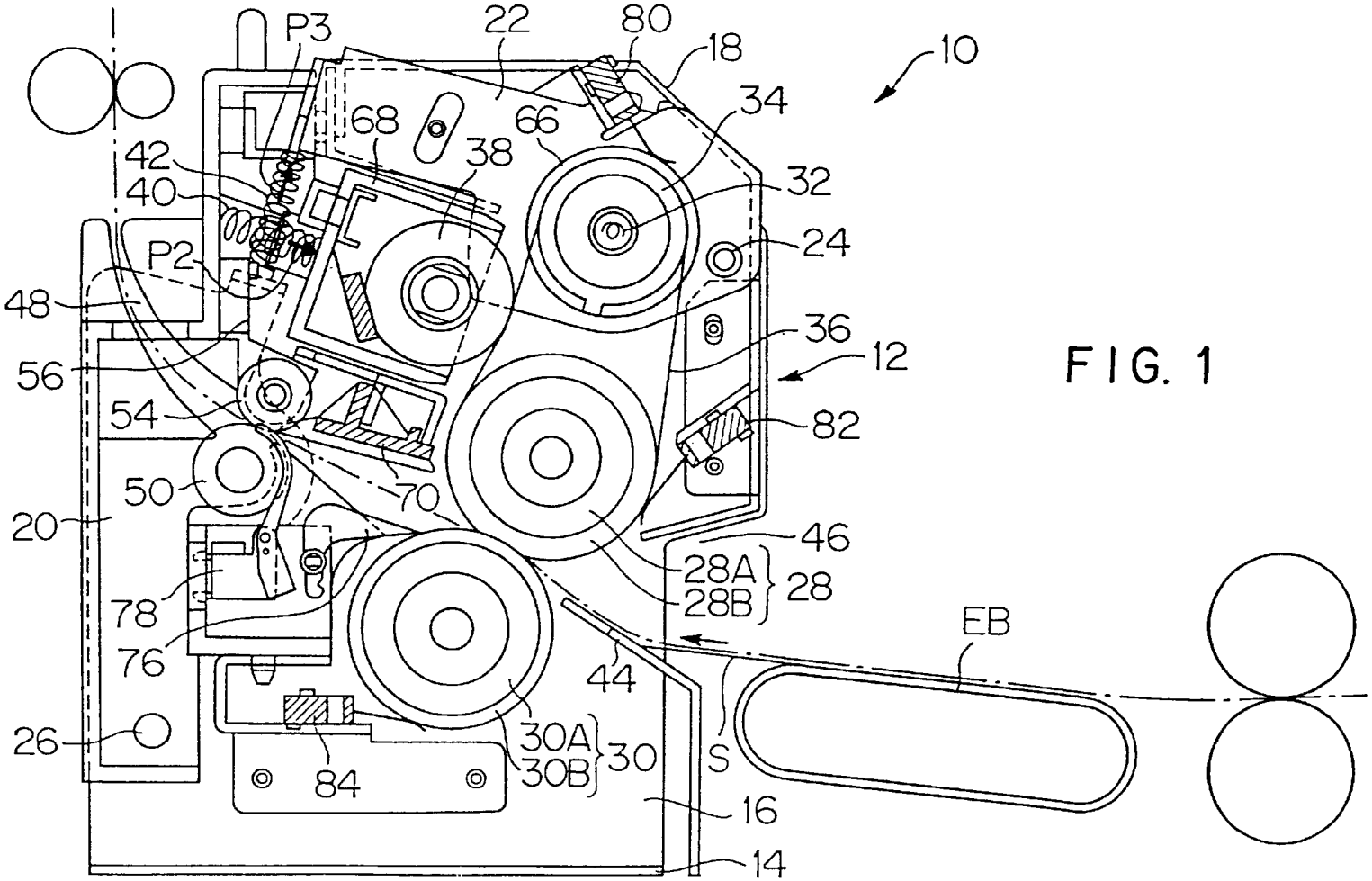
FIG. 1 is a sectional front elevational view of a toner image fixing apparatus according to an embodiment of the present invention.

General structure of toner image fixing apparatus 10:

As shown in FIG. 1, a toner image fixing apparatus 10 according to an embodiment of the present invention has a housing 12 to be fixed to a frame of an electronic image forming system (not shown) such as an electrophotographic copying system, for example. The housing 12 comprises a base plate 14 to be fixed directly to the frame, a pair of vertical side plates 16 erected from respective side edges of the base plate 14, an upper cover 18 mounted on the side plates 16 to cover upper right regions of the side plates 16, and a left cover 20 mounted on the side plates 16 to cover left side regions of the side plates 16.

The upper cover 18 is fixedly mounted on the side plates 16. A swing lever 22 is swingably supported on right portions of the side plates 16 by a first pivot shaft 24 positioned on a right end of the swing lever 22, for swinging movement about the first pivot shaft 24 to provide an open space at a left end of the swing lever 22. The left cover 20 is swingably supported on the side plates 16 by a second pivot shaft 26 positioned on a 41 lower end of the left cover 20, for swinging movement about the second pivot shaft 24 to provide an open space at an upper end of the left cover 20.

The toner image fixing apparatus 10 has a roller assembly including a fixing roller 28 rotatably supported on the side plates 16 for rotation about a fixed axis, a pressing roller 30 positioned obliquely downwardly of the fixing roller 28 in rolling contact with the fixing roller 28 and rotatably supported on the side plates 16 for rotation about a fixed axis parallel to the fixed axis of the fixing roller 28, and a heating roller 34 positioned obliquely upwardly of the fixing roller 28 and rotatably supported on the swing lever 22 for rotation about its own axis. The heating roller 34 has a heater 32 such as a halogen lamp or the like disposed therein. An endless fixing belt (heat transfer belt) 36 is trained around the fixing roller 28 and the heating roller 34.

Figure 2:
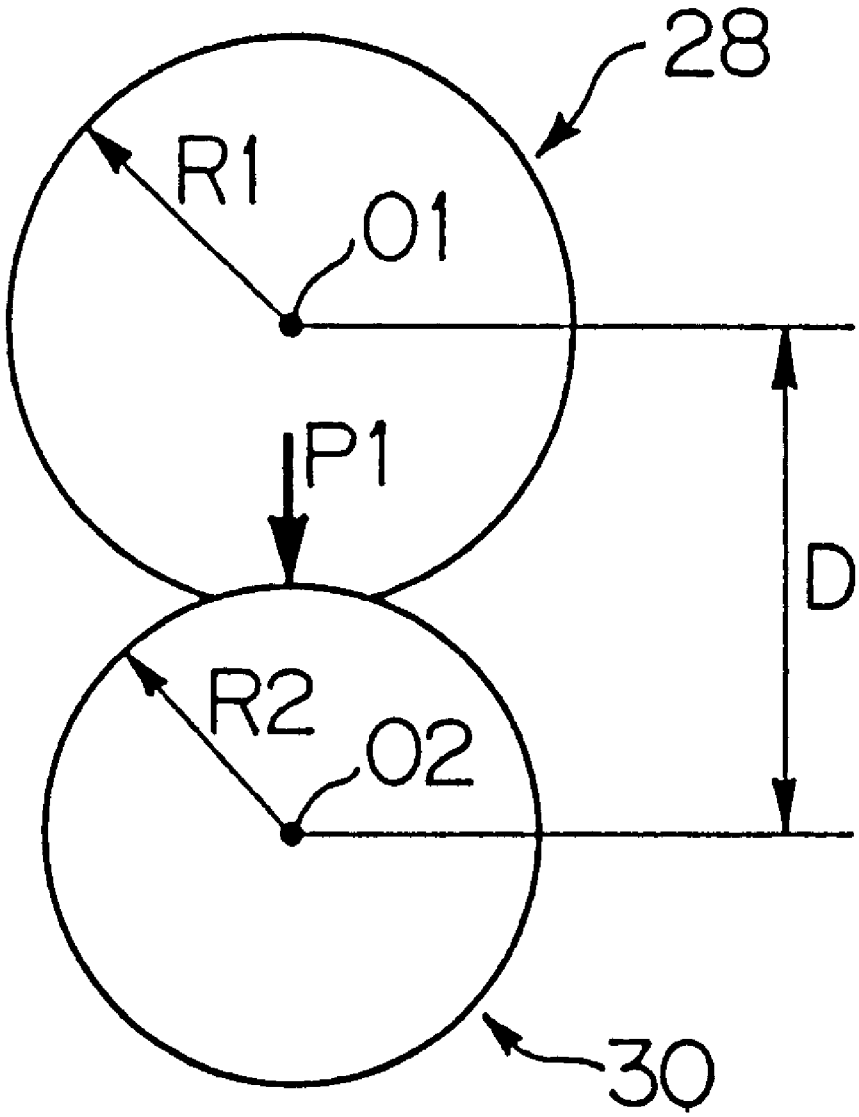
FIG. 2 is a schematic view showing the manner in which a fixing roller and a pressing roller are held in rolling contact with each other.

The fixing roller 28 comprises a resilient roller, and the pressing roller 30 comprises a roller harder than the fixing roller 28. As shown in FIG. 2, the fixing roller 28 and the pressing roller 30 have respective centers O1, O2 spaced from each other by a distance D which is slightly smaller than the sum (R1+R2) of their radii R1, R2. In a rolling contact region (nipping region) between the fixing roller 28 and the pressing roller 30, the fixing roller 28 and the pressing roller 30 are held in rolling contact with each other under a predetermined pressure P1, so that the fixing roller 28 has an outer circumferential surface made partly concave by the pressing roller 30 held in rolling contact therewith, thus providing a sufficient nipping width in a direction across the axes of the fixing roller 28 and the pressing roller 30.

The toner image fixing apparatus 10 also has an oil applying roller 38 for applying silicone oil to an outer circumferential surface of the fixing belt 36 and cleaning the outer surface of the fixing belt 36, a first helical spring 40 for normally pressing the oil applying roller 38 against the fixing belt 36 perpendicularly thereto to tension the fixing belt 36, and a second helical spring 42 for normally urging the heating roller 34 in a direction away from the fixing roller 28 to tension the fixing belt 36 in coaction with the first helical spring 40.

The upper cover 18 has a right lower portion bent inwardly into the housing 12. A guide plate 44 is positioned below and largely spaced from the bent right lower portion of the upper cover 18. The guide plate 44 and the bent right lower portion of the upper cover 18 jointly define an inlet port 46 therebetween for introducing therethrough a sheet S with an unfixed toner image carried thereon (hereinafter referred to as an "unfixed toner sheet") into the housing 12 in the direction (feed direction) indicated by the arrow in FIG. 1.

The guide plate 44 is inclined obliquely upwardly to the left such that the height of the guide plate 44 progressively increases into the housing 12. The guide plate 44 has an inlet end, i.e., a right end, positioned in confronting relation to an outlet end of a sheet feeding endless belt EB that is positioned in the electrophotographic copying system adjacent to the right end of the inlet port 46. The guide plate 44 has an outlet end, i.e., a left end, positioned in confronting relation to the rolling contact region (nipping region) between the fixing roller 28 and the pressing roller 30.

When the unfixed toner sheet S is fed in the feed direction indicated by the arrow toward the toner image fixing apparatus 10 by the endless belt EB, the leading end of the unfixed toner sheet S contacts the guide plate 44, and is then guided thereby to travel obliquely upwardly into the rolling contact region between the fixing roller 28 and the pressing roller3o.

A sheet discharge passage 48 is defined above the left cover 20 for discharging a sheet with a toner image fixed thereto with heat and pressure by the fixing roller 28 and the pressing roller 30 in the rolling contact region. Such a sheet will hereinafter be referred to as a "fixed toner sheet"). The sheet discharge passage 48 is oriented such that it discharges the fixed toner sheet substantially upwardly along a vertical plane.

A lower discharge roller 50 is rotatably mounted on the left cover 20 between the sheet discharge passage 48 and the rolling contact region. The lower discharge roller 50 is actuated by an actuating mechanism 52 (described later on) to rotate at a speed greater than the pressing roller 30, i.e., at a speed which is 5% greater than the speed at which the pressing roller 30 rotates. An upper discharge roller 54 is positioned obliquely upwardly of the lower discharge roller 50 and held in rolling contact with the lower discharge roller 50 under resilient forces from a leaf spring 56. The upper discharge roller 54 is positioned with respect to the lower discharge roller 50 such that a line interconnecting the centers of the upper and lower discharge rollers 54, 50 extends substantially perpendicularly across a sheet discharge passage along which the fixed toner sheet is delivered from the rolling contact region to the sheet discharge passage 48.

In the toner image fixing apparatus 10 thus constructed, the unfixed toner sheet S fed onto the guide plate 44 by the endless belt EB has its lower surface, opposite to the unfixed toner image, borne by the guide plate 44, and is guided by the guide plate 44 toward the rolling contact region (nipping region) between the fixing roller 28 and the pressing roller 30, with the fixing belt 36 being trained around the fixing roller 28. When the unfixed toner sheet S passes under pressure between the fixing roller 28 and the pressing roller 30, the unfixed toner image is fixed to the sheet S with heat and pressure.

Fixing roller 28:

The fixing roller 28 comprises a core 28A rotatably supported on the side plates 16 by bearings (not shown) and a roller sleeve 28B fitted coaxially over the core 28A. The fixing belt 36 is trained around the roller sleeve 28B. The fixing roller 28 has an outside diameter of 38.5 mm in this embodiment. The core 28A comprises a shaft of iron having a diameter of 25 mm, and the roller sleeve 28B is made of a heat-resistant resilient material of silicone rubber having a wall thickness of 6.75 mm. Specifically, the roller sleeve 28B is made of silicone rubber sponge having an Asker Model C hardness of 35.

Figure 3:
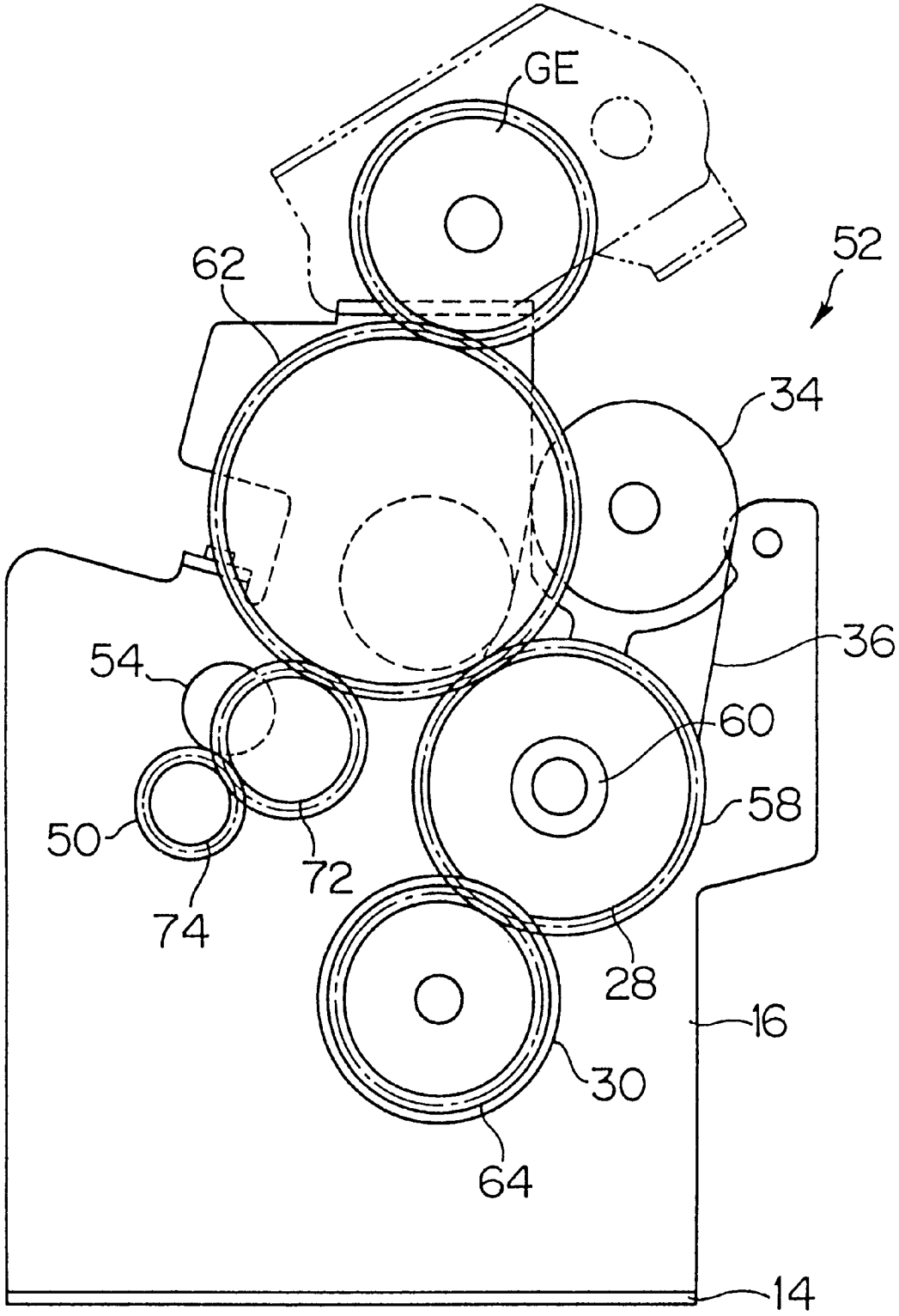
FIG. 3 is a schematic front elevational view of an actuating mechanism of the toner image fixing apparatus shown in FIG. 1.

As shown in FIG. 3, the core 28A has an end combined with a shaft which is coaxially coupled to a first driven gear 58 through a one-way clutch 60 (described later on). The first driven gear 58 is held in mesh with a transmission gear 62 of the actuating mechanism 52. Drive forces produced by the actuating mechanism 52 are transmitted through the transmission gear 62 to the first driven gear 58 which is rotated clockwise to rotate the fixing roller 28 through the one-way clutch 60.

Pressing roller 30:

As shown in FIG. 1, the pressing roller 30 comprises a core 30A rotatably supported on the side plates 16 by bearings (not shown) and a roller sleeve 30B fitted coaxially over the core 30A. The pressing roller 30 has an outside diameter of 35 mm in this embodiment. The core 30A comprises a shaft of iron having a diameter of 32 mm, and the roller sleeve 30B is made of a heat-resistant resilient material of silicone rubber having a wall thickness of 1.5 mm. Specifically, the roller sleeve 30B is made of silicone rubber sponge having a JIS Model A hardness of 20, which is harder than the roller sleeve 28B. The outer circumferential surface of the roller sleeve 30B is covered with a tube of fluoroplastics having a wall thickness of 50 $\mu$m.

As shown in FIG. 3, the core 30A has an end combined with a shaft which is coaxially coupled to a second driven gear 64 which is held in mesh with the first driven gear 58. Drive forces are transmitted from the first driven gear 58 to the second driven gear 64, which rotates the pressing roller 30 counterclockwise.

In this embodiment, the pressing roller 30 is used as a primary drive roller for establishing a speed at which the unfixed toner sheet is fed through the nipping region. The ratio of gear teeth of the first and second drive gears 58, 64 is selected such that the peripheral speed of the fixing roller 28 as it is thermally expanded is not greater than the peripheral speed of the pressing roller 30. Specifically, the speed at which the fixing roller 28 is rotated by the first driven gear 58 is slightly lower than the speed at which it is rotated in frictional engagement with the pressing roller 30 through the fixing belt 36.

The pressing roller 30 is not positioned directly downwardly of the fixing roller 28, but is displaced downstream in the feed direction of a position directly downward of the fixing roller 28. Specifically, the pressing roller 30 is positioned with respect to the fixing roller 28 such that an acute angle is formed between a vertical line passing through the center of the fixing roller 28 and a line segment passing through the centers of the fixing roller 28 and the pressing roller 30. The line segment passing through the centers of the fixing roller 28 and the pressing roller 30 extends perpendicularly to the feed direction across the rolling contact region.

One-way clutch 60:

The one-way clutch 60 allows the fixing roller 28 to rotate clockwise relatively to the first driven gear 58, but prevents the fixing roller 28 from rotating counterclockwise relatively to the first driven gear 58, i.e., rotates the fixing roller 28 and the first driven gear 58 in unison with each other. Specifically, when the fixing roller 28 is cold, i.e., when the fixing roller 28 and the fixing belt 36 are driven by the pressing roller 30 while the fixing belt 36 is held in frictional engagement with the pressing roller 30 and the fixing roller 28 is held in frictional engagement with the fixing belt 36, the peripheral speed of the fixing roller 28 upon clockwise rotation thereof is the same as the peripheral speed of the pressing roller 30, and hence is slightly higher than the peripheral speed of the first driven gear 58. The difference between the peripheral speeds of the fixing roller 28 and the first driven gear 58 is absorbed by the one-way clutch 60.

When the heating roller 34 is heated by the heater 32 and the fixing roller 28 is heated through the fixing belt 36, the outside diameter of the fixing roller 28 is increased as it is thermally expanded, and the peripheral speed of the fixing roller 28 increases. Since the peripheral speed of the fixing roller 28 does not become higher than the peripheral speed of the pressing roller 30, the increase in the peripheral speed of the fixing roller 28 is absorbed by the one-way clutch The one-way clutch 60 offers the following advantages: If the one-way clutch 60 were not employed, when a sheet with a glossy and slippery surface, such as a coated sheet, is fed as an unfixed toner sheet into the rolling contact region, the fixing belt 36 would slip against the unfixed toner sheet, and drive forces would not be transmitted from the pressing roller 30 to the fixing belt 36 and the fixing roller 28, which would not then be driven by the pressing roller 30. Therefore, the unfixed toner sheet would be jammed in the rolling contact region, or even if the unfixed toner sheet passed through the rolling contact region, the unfixed toner image on the unfixed toner sheet would be abraded and disturbed by the fixing belt 36 kept at rest.

In this embodiment, however, since the one-way clutch 60 is connected between the fixing roller 28 and the first driven gear 58, even if drive forces from the pressing roller 30 are not transmitted to the fixing belt 36, the fixing roller 28 is rotated clockwise by the first driven gear 58 through the one-way clutch 60 when the peripheral speed of the fixing roller 28 starts being lower than the peripheral speed of the first driven gear 58. Therefore, the unfixed toner sheet passes reliably through the rolling contact region for effective protection against a sheet jam in the nipping region and toner image disturbance on the sheet.

Heating roller 34:

In this embodiment, the heater in the heating roller 34 comprises a 800 W halogen lamp which is designed to emit light at an intensity that is 50% greater in opposite end regions than in a central region thereof. The heating roller 34 comprises a core in the form of an aluminum pipe having a diameter of 30 mm and a wall thickness of 3.5 mm. The core is coated with a polytetrafluoroethylene (PTFE) layer having a thickness of 20 $\mu$m. A circular collar 66 made of heat-resistant polyetheretherketone (PEEK) and having a diameter of 30 mm is press-fitted over each of opposite bearing ends of the core for preventing the fixing belt 36 from being tortured or displaced out of position.

Fixing belt 36:

The fixing belt 36 preferably has a heat capacity of 0.002 cal/° C.–0.025 cal/° C. per $cm^2$ so as to be able to preheat the unfixed toner on the unfixed toner sheet S to a fixing temperature through heat radiation for thereby fixing the toner without applying excessive heat. In this embodiment, the fixing belt 36 comprises an endless belt base of polyimide having a thickness of 100 $\mu$m and a heat-resistant resilient separating layer of silicone rubber that is coated to a thickness of 150 $\mu$m on an outer circumferential surface of the endless belt base of polyimide.

Alternatively, the fixing belt 36 may comprise an endless belt base of electroformed nickel having a thickness of 40 $\mu$m and a heat-resistant resilient separating layer of silicone rubber that is coated to a thickness of 150 $\mu$m on an outer circumferential surface of the endless belt base of electroformed nickel.

Oil applying roller 38:

The oil applying roller 38 serves to apply a small amount of silicone oil to the outer circumferential surface of the fixing belt 36 for separating the sheet S easily from the fixing belt 36. The oil applying roller 38 comprises a support shaft 38A rotatably supported in a casing 68 for rotation about a fixed axis and a heat-resistant layer 38B of paper fitted over the support shaft 38A and impregnated with silicone coil. In this embodiment, the support shaft 38A comprises a shaft of iron having a diameter of 8 mm, and the heat-resistant layer 38B of paper is covered with a film 38C of porous fluoroplastics having a thickness of 100 $\mu$m. The oil applying roller 38 has a diameter of 22 mm. The oil applying roller 38 thus constructed is capable of stably applying a small amount of silicone oil to the outer circumferential surface of the fixing belt 36.

The outer circumferential surface of the oil applying roller 38 is smeared with dirt such as of toner particles that is transferred from the outer circumferential surface of the fixing belt 36. A cleaning brush 39 is held in sliding contact with the outer circumferential surface of the oil applying roller 38 for removing such dirt off the outer circumferential surface of the oil applying roller 38 thereby to clean the oil applying roller 38.

Tensioning mechanism for the fixing belt 36:

As described above, a mechanism for tensioning the fixing belt 36 has the first helical spring 40 for normally pressing the oil applying roller 38 against the fixing belt 36 perpendicularly thereto to tension the fixing belt 36, and the second helical spring 42 for normally urging the heating roller 34 in a direction away from the fixing roller 28 to tension the fixing belt 36 in coaction with the first helical spring 40.

The first helical spring 40 is attached to the left cover 20 for normally urging the casing 68, on which the oil applying roller 38 is rotatably supported, toward the fixing belt 36. The casing 68 is movably supported by a guide ring 70 on one of the side plates 16 for movement toward and away from the fixing belt 36. When the left cover 20 is swung open to the left about the second pivot shaft 26, the first helical spring 40 is disengaged from the casing 68, releasing the oil applying roller 38 from the fixing belt 36. When the left cover 20 is swung to the right about the second pivot shaft 26, the first helical spring 40 pushes the casing 68 under a pressing force P2, causing the oil applying roller 38 to press the fixing belt 36 under a certain tension.

The second helical spring 42 is connected between the left end of the swing lever 22 and the side plate 16 for normally urging the swing lever 22 to turn clockwise about the first pivot shaft 24, i.e., to push the heating roller 34 on the swing lever 22 under a pressing force P3 in a direction away from the fixing roller 28. In this manner, the fixing belt 36 is given a desired tension.

Therefore, the heating roller 34 is displaced away from the fixing roller 28 by the swing lever 22 under the bias of the second helical spring 42, tensioning the fixing belt 36 trained around the heating roller 34 and the fixing roller 28.

The fixing belt 36 thus tensioned by the first and second helical springs 40, 42 is held in frictional engagement with the pressing roller 30 and driven thereby. When the fixing belt 36 is driven by the pressing roller 30, the fixing roller 28 is stably driven thereby without slipping or sagging with respect to the fixing belt 36.

Actuating mechanism 52:

As shown in FIG. 3, the transmission gear 62 is held in mesh with an output gear GE that is connected through a gear train (not shown) to an actuator in the electrophotographic copying system when the toner image fixing apparatus 10 is installed in the electrophotographic copying system. The transmission gear 62 can be driven to rotate by the output gear GE. The actuating mechanism 52 also has, in addition to the transmission gear 62, the first driven gear 58 held in mesh with the transmission gear 62 and coupled to the fixing roller 28 through the one-way clutch 60, and the second driven gear 64 held in mesh with the first driven gear 58 and fixed coaxially to the pressing roller 30.

The actuating mechanism 52 also has an idler gear 72 held in mesh with the transmission gear 62. The idler gear 72 is also held in mesh with a third driven gear 74 fixed coaxially to the lower discharge roller 50 for rotating the lower discharge roller 50 at a speed equal to or higher than the rotational speed of the pressing roller 30.

Other structural details:

As shown in FIG. 1, the toner image fixing apparatus 10 has a peeler blade 76 for peeling the fixed toner sheet off the outer circumferential surface of the pressing roller 30, and a sheet sensor 78 for detecting the leading end of the fixed toner sheet as it is fed to a rolling contact region between the upper and lower discharge rollers 54, 50.

Figure 4:
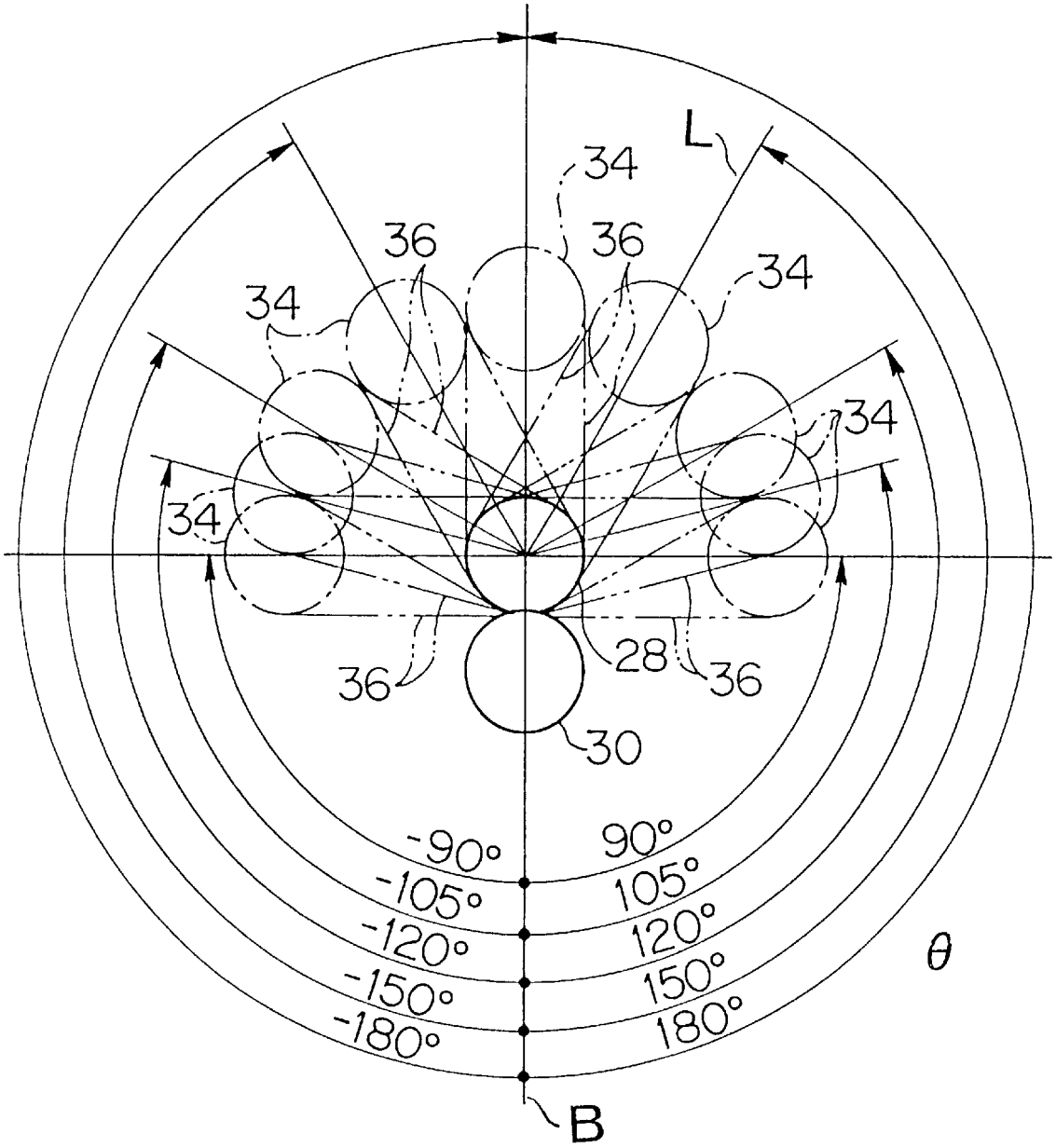
FIG. 4 is a diagram showing angles employed in an experiment conducted to check an allowable range of positions of a heating roller with respect to the fixing roller.

As shown in FIGS. 1 and 4, the toner image fixing apparatus 10 further includes a first thermistor 80 for detecting the temperature of the fixing belt 36 trained around the heating roller 34, a second thermistor 82 for detecting the temperature of the outer circumferential surface of the fixing belt 36 trained around the fixing roller 38, a third thermistor 84 for detecting the temperature of the outer circumferential surface of the pressing roller 84, and a control circuit 86 for controlling the heater 32 based on the temperatures detected by the first, second, and third thermistors 80, 82, 84. The control circuit 86 controls the heater 32 through a heater driver 88.

Position of the heating roller 34:

The heating roller 34 is positioned substantially upwardly of the fixing roller 28. Therefore, the fixing belt 36 that is trained around the fixing roller 28 and the heating roller 34 is so spaced from the guide plate 44 that the unfixed toner sheet fed on the guide plate 44 will not be brought into contact with the fixing belt 36. Stated otherwise, the fixing belt 36 is disposed in a position outside of a region where the unfixed toner sheet fed on the guide plate 44 possibly passes.

Because the heating roller 34 is positioned substantially upwardly of the fixing roller 28, the unfixed toner sheet S carried on the upper surface of the guide plate 44 is reliably prevented from contacting the fixing belt 36 irrespective of how the unfixed toner sheet being fed may be curled. Consequently, the unfixed toner sheet can be led to the rolling contact region between the fixing roller 28 and the pressing roller 30 without disturbing the unfixed toner image on the unfixed toner sheet S, so that the unfixed toner image on the unfixed toner sheet S can reliably be fixed to the unfixed toner sheet S in the rolling contact region.

Figure 5:
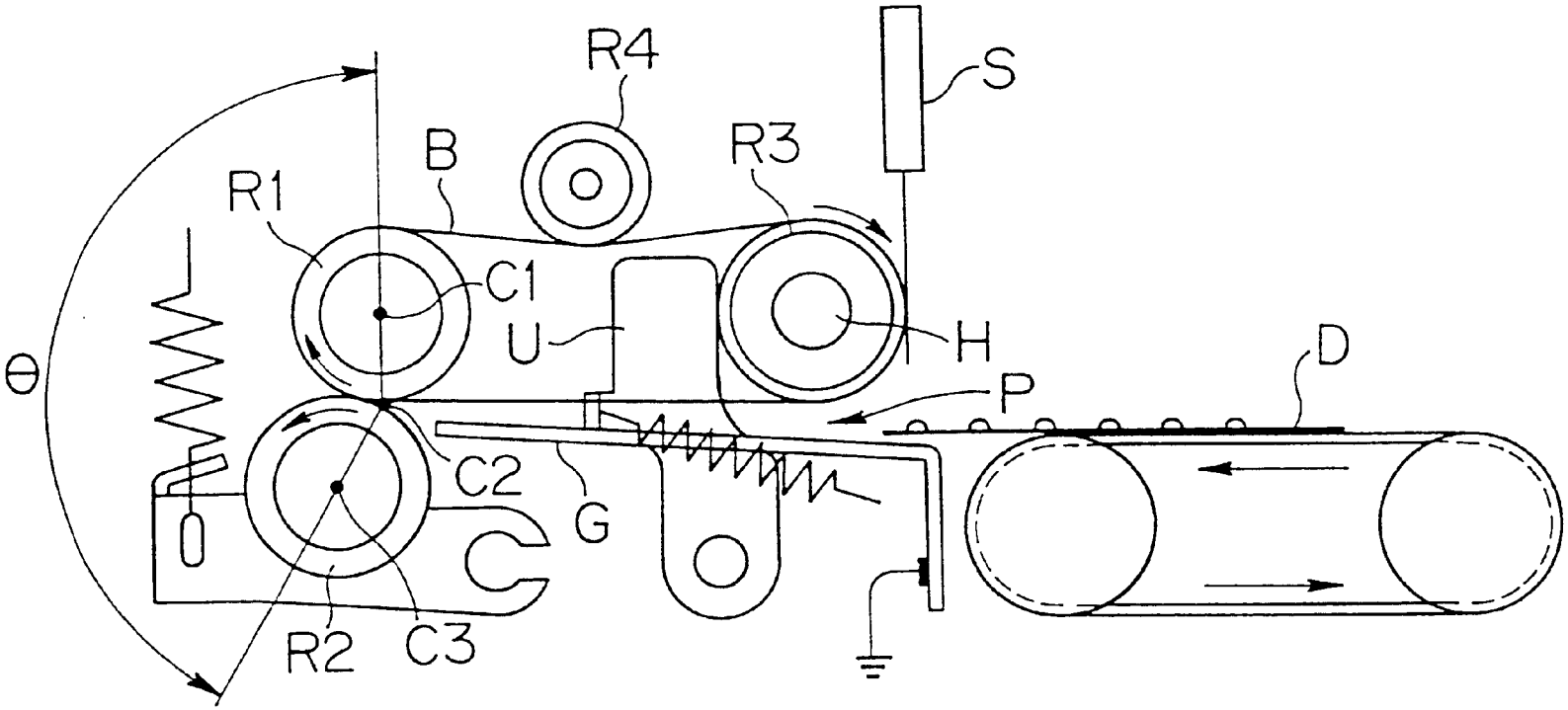
PRIOR ART FIG. 5
FIG. 5 is a sectional front elevational view of a conventional toner image fixing apparatus.

Angle of the heating roller 34:

The fact that the heating roller 34 is positioned substantially upwardly of the fixing roller 28 offers advantages inherent in the toner image fixing apparatus 10. An experiment to determine an optimum angular range in which the heating roller 34 can be positioned substantially upwardly of the fixing roller 28 by changing the angle of the heating roller 34 as shown in FIG. 5 will be described below.

In the experiment, a straight line passing through the centers of the fixing roller 28 and the pressing roller 30 was defined as a reference line B, and an angle θ was defined between the reference line B and a line segment L interconnecting the centers of the fixing roller 28 and the heating roller 34. The angular position of the heating roller 34 with respect to the fixing roller 28 was changed to change the angle 6 between 90° and 180°, and the frequency of rubbed states of toner images at the inlet of the rolling contact region between the fixing roller 28 and the pressing roller 30 and also the frequency of defects of toner images at the outlet of the rolling contact region between the fixing roller 28 and the pressing roller 30 were measured when the toner images were copied on one side and both sides of sheets.

The angle θ was defined as a positive angle when measured counterclockwise from the reference line B, and as a negative angle when measured clockwise from the reference line B. Therefore, the heating roller 34 positioned at the angle θ=+180° and the heating roller 34 positioned at the angle θ=−180° were in the same angular position, and the heating roller 34 positioned at the angle θ=+105° and the heating roller 34 positioned at the angle θ=−255° were in the same angular position. Defects of toner images at the outlet of the rolling contact region represent sheet offsets or sheet jams.

The experiment was conducted under the following conditions:

The nipping width in the rolling contact region was set to 8 mm, and the pressing roller 30 applied a pressure P1 of 24 kgf to one side of the unfixed toner sheet S. The temperature of the fixing belt 36 trained around the fixing roller 28 was set to 160° C. The surface temperature of the pressing roller 30 was set to 140° C. The speed at which to feed the unfixed toner sheet S was set to 180 mm/sec. The pressing roller 30 was rotated in synchronism with the speed of 180 mm/sec. The toner used was an A color toner manufactured by Fuji Xerox. The sheet S used was plain paper having a weight of 64 g/m$^2$.

The experiment was made for nine angles θ of 90°, 105°, 120°, 150°, 180°, −150°, −120°, −105°, −90°.

The results of the experiment are given in Table 1 shown below.

TABLE 1

| Angles | Copied on one side A | Copied on one side B | Copied on both sides A | Copied on both sides B | Evaluation |
|---|---|---|---|---|---|
| 90° | 3/5 | 0/5 | 5/5 | 0/5 | Not acceptable |
| 105° | 0/5 | 0/5 | 1/5 | 0/5 | Partly acceptable |
| 120° | 0/5 | 0/5 | 0/5 | 0/5 | Acceptable |
| 150° | 0/5 | 0/5 | 0/5 | 0/5 | Acceptable |
| ±180° | 0/5 | 0/5 | 0/5 | 0/5 | Acceptable |
| −150° | 0/5 | 0/5 | 0/5 | 0/5 | Acceptable |
| −120° | 0/5 | 0/5 | 0/5 | 0/5 | Acceptable |
| −105° | 0/5 | 2/5 | 0/5 | 3/5 | Not acceptable |
| −90° | 0/5 | 5/5 | 0/5 | 5/5 | Not acceptable |

A: The frequency of rubbed states of toner images at the inlet of the rolling contact region.
B: The frequency of defects of toner images at the outlet of the rolling contact region.

As can be seen from Table 1, when the angle e is greater than 105° and smaller than −105°, i.e., when the angle θ is in a range from 105° to 255° as measured only counterclockwise, toner images were neither rubbed at the inlet of the rolling contact region and nor defective at the outlet of the rolling contact region, indicating a good toner image fixing process. However, when the angle θ is equal or smaller than 105°, toner images were either rubbed at the inlet of the rolling contact region and or defective at the outlet of the rolling contact region, indicating a poor toner image fixing process.

In the above embodiment, the heating roller 34 is positioned substantially upwardly of the fixing roller 28, i.e., the heating roller 34 is angularly positioned with respect to the fixing roller 28 such that the angle formed between the line segment L interconnecting the center of the heating roller 34 and the center of the fixing roller 28 and the reference line B interconnecting the center of the fixing roller 28 and the center of the pressing roller 30 lies in a range from about 105° to about 255°. Therefore, the fixing belt 36 that is trained around the fixing roller 28 and the heating roller 34 is so spaced from the guide plate 44 that the unfixed toner sheet fed on the guide plate 44 will not be brought into contact with the fixing belt 36. Stated otherwise, the fixing belt 36 is disposed in a position outside of a region where the unfixed toner sheet fed on the guide plate 44 possibly passes.

Consequently, no matter how the unfixed toner sheet being fed is curled due to jumping or sagging on account of the speed difference between a speed difference between the toner image fixing apparatus 10 and a preceding toner image transferring apparatus, the unfixed toner image on the upper surface of the unfixed toner sheet is reliably prevented from touching the fixing belt 36, and can be led, without being disturbed, into the rolling contact region between the fixing roller 28 and the pressing roller 30, so that the toner image can reliably be fixed to the sheet by the fixing roller 28.

The fixing roller 28 comprises a resilient roller, and the pressing roller 30 comprises a roller harder than the fixing roller 28. Therefore, even if the fixing roller 28 and the pressing roller 30 are small in diameter, they provide a sufficiently large nipping width zero in a direction across their axes. As a consequence, the toner image fixing apparatus 10 may be relatively small in size, and sheets can be fed through toner image fixing apparatus 10 at high speed. The toner image fixing apparatus 10 is thus suitable for use in color printers.

As described above, inasmuch as the fixing roller 28 positioned above the pressing roller 30 comprises a resilient roller and the pressing roller 30 comprises a roller harder than the fixing roller 28, the fixing roller 28 provides an upwardly concave surface in the nipping region, unlike the conventional structure shown in FIG. 9. The upwardly concave nipping region provided by the fixing roller 28 produces forces tending to separate a sheet carrying a fixed toner image from the fixing belt 36. Even though the toner is carried on the surface of the sheet held in contact with the fixing belt 36, because the sheet can easily be separated from the fixing belt 36 due to the upwardly concave nipping region, the amount of oil applied to the fixing belt 36 by the oil applying roller 38 for preventing sheet offsets and jams may be relatively small. Actually, the upwardly concave nipping region provided by the fixing roller 28 is effective to avoid sheet offsets and jams between the fixing roller 28 and the pressing roller 30 even without the application of oil to the fixing belt 36 by the oil applying roller 38.

Furthermore, the fixing belt 36 is made of a material having a small heat capacity, trained around the heating roller 34 at a large contact angle, and held in intimate contact with the heating roller 34. As a result, even when sheets are passed at a high speed, i.e., even when a large number of sheets are passed in a unit time, through the nipping region, the temperature necessary to fix toner images to the sheets can reliably be maintained in the rolling contact region between the fixing roller 28 and the pressing roller 30.

In the embodiment, the resilient fixing roller 28 does not house any heater, but the heating roller 34 spaced from the fixing roller 28 houses the heater 32 therein. Thus, it is possible to sufficiently increase the thickness of the roller sleeve 28B that is made of a heat-resistant resilient material. Consequently, the nipping width in the rolling contract region can be sufficiently large while at the same time the fixing roller 28 may be relatively small in diameter.

In addition, the one-way clutch 60 disposed between the first driven gear 58 and the fixing roller 28 allows the pressing roller 30, rather than the fixing roller 28, as a primary drive roller for establishing a speed at which the unfixed toner sheet is fed through the nipping region. Therefore, even when the fixing roller is heated in the fixing process and thermally expanded to increase its diameter, since the speed at which the unfixed toner sheet is fed through the nipping region is not established by the fixing roller 28, it is not varied by the thermal expansion of the fixing roller 28, but is maintained at a constant level. Consequently, the fixing belt 36 is maintained at a constant linear velocity to prevent toner images from being displaced or rubbed.

Modifications:

The toner image fixing apparatus 10 has been described as being used in an electrophotographic copying system. However, the principles of the present invention are not limited to such an application, but are also applicable to other electronic image forming systems including an electronic facsimile machine, an electronic printer, etc.

In the above embodiment, the unfixed toner sheet is introduced laterally into the toner image fixing apparatus 10. However, the unfixed toner sheet may be introduced vertically, e.g., upwardly, into the toner image fixing apparatus 10. In such a modification, the pressing roller 30 is disposed laterally of the fixing roller 28, and the heating roller 34 is disposed on one side of the fixing roller 28 which is opposite to the pressing roller 30.

In the above embodiment, the third thermistor 84 is provided to detect the temperature of the outer circumferential surface of the pressing roller 30. However, the third thermistor 84 may be dispensed with.

Although certain preferred embodiments of the present invention have been shown and described in detail, it should be understood that various changes and modifications may be made therein without departing from the scope of the appended claims.

What is claimed is:

1. A toner image fixing apparatus comprising:

a fixing roller;

a pressing roller normally urged toward said fixing roller for pressing a sheet with an unfixed toner image carried on a surface thereof against said fixing roller to fix the unfixed toner image to said sheet when said sheet passes in one direction through a rolling contact region between said fixing roller and said pressing roller;

a heating roller disposed on one side of said fixing roller opposite to said pressing roller, said heating roller having heating means disposed therein for heating said heating roller; and an endless heat transfer belt trained around said heating roller and said fixing roller for transferring heat from said heating means to heat the unfixed toner image on said sheet when said sheet passes through said rolling contact region;

said heating roller being angularly positioned with respect to said fixing roller such that an angle formed between a line segment interconnecting the center of said heating roller and the center of said fixing roller and a reference line interconnecting the center of said fixing roller and the center of said pressing roller lies in a range from 105° to 255°.

2. The toner image fixing apparatus according to claim 1, further comprising:

actuating means for rotating said pressing roller;

said endless heat transfer belt being held in frictional engagement with said pressing roller for being rotated thereby, so that said fixing roller can be rotated by said pressing roller through said endless heat transfer belt.

3. The toner image fixing apparatus according to claim 1, wherein said endless heat transfer belt comprises an endless belt base of a heat transmission material and a separating layer coated on an outer circumferential surface of the endless belt base.

4. The toner image fixing apparatus according to claim 3, wherein said endless belt base is made of electroformed nickel.

5. The toner image fixing apparatus according to claim 3, wherein said endless belt base is made of polyimide.

6. The toner image fixing apparatus according to claim 1, further comprising:

actuating means for rotating said pressing roller;

said endless heat transfer belt being held in frictional engagement with said pressing roller for being rotated thereby.

7. The toner image fixing apparatus according to claim 1, further comprising:

a support member fixedly positioned upstream of said pressing roller with respect to said one direction, for supporting an opposite surface of said sheet before said sheet passes through said rolling contact region;

said endless heat transfer belt and said support member being so spaced from each other that said sheet supported by said support member is kept out of contact with said endless heat transfer belt.

8. The toner image fixing apparatus according to claim 1, further comprising:

a support member fixedly positioned upstream of said pressing roller with respect to said one direction, for supporting an opposite surface of said sheet before said sheet passes through said rolling contact region;

said endless heat transfer belt being positioned outside of a region where said sheet supported by said support member possibly passes.

9. The toner image fixing apparatus according to claim 1, wherein, said fixing roller comprises a resilient roller having a resilient layer on an outer circumferential surface thereof.

10. The toner image fixing apparatus according to claim 7, further comprising:

actuating means for rotating said pressing roller;

said endless heat transfer belt being held in frictional engagement with said pressing roller for being rotated thereby, so that said fixing roller can be rotated by said pressing roller through said endless heat transfer belt.

11. The toner image fixing apparatus according to claim 10, wherein said actuating means comprises means for rotating said fixing roller at a peripheral speed lower than said pressing roll.

12. The toner image fixing apparatus according to claim 11, wherein said fixing roller has a driven gear coaxially coupled thereto, said actuating means having a drive gear held in mesh with said driven gear, further comprising a one-way clutch coupled between said driven gear and said fixing roller for allowing said fixing roller to rotate faster than said driven gear and inhibiting said fixing roller from rotating slower than said driven gear.

13. The toner image fixing apparatus according to claim 9, wherein said fixing roller comprises a core and a resilient layer disposed around said core and having a predetermined thickness.

14. The toner image fixing apparatus according to claim 9, wherein said pressing roller comprises a roller harder than said resilient layer of the resilient roller.

15. The toner image fixing apparatus according to claim 9, wherein said pressing roller is supported for rotation about a fixed axis.

16. The toner image fixing apparatus according to claim 15, wherein said fixed axis about which said pressing roller is rotatable is spaced from an axis about which said fixing roller is rotatable by a distance which is smaller than the sum of the radii of said pressing roller and said fixing roller.

* * * * *

UNITED STATES PATENT AND TRADEMARK OFFICE

CERTIFICATE OF CORRECTION

PATENT NO. : 6,137,984
DATED : October 24, 2000
INVENTOR(S) : Higashi et al.

It is certified that error appears in the above-identified patent and that said Letters Patent is hereby corrected as shown below:

On the Title Page
Insert Item [30];
-- [30] Foreign Application Priority Data

| | | | |
|---|---|---|---|
| Feb. 9, 1998 | [JP] | Japan | 10-40962 |
| Feb. 9, 1998 | [JP] | Japan | 10-40963 |
| Feb. 9, 1998 | [JP] | Japan | 10-40964 --. |

Signed and Sealed this

Twenty-fourth Day of July, 2001

*Attest:*

Nicholas P. Godici

NICHOLAS P. GODICI
*Acting Director of the United States Patent and Trademark Office*

*Attesting Officer*